United States Patent [19]

Birat et al.

[11] Patent Number: 4,562,879

[45] Date of Patent: Jan. 7, 1986

[54] ELECTROMAGNETICALLY STIRRING THE MELT IN A CONTINUOUS-CASTING MOLD

[75] Inventors: Jean-Pierre Birat, Semecourt; Patrick Neu, Hagondange; Denis Senaneuch, Dunkerque, all of France

[73] Assignee: Institut de Recherches de la Siderurgie Francaise, Saint-Germain-en-Laye, France

[21] Appl. No.: 504,845

[22] Filed: Jun. 17, 1983

[30] Foreign Application Priority Data

Jun. 18, 1982 [FR] France ..... 82 10844

[51] Int. Cl.[4] ..... B22D 11/00

[52] U.S. Cl. ..... 164/468; 164/504

[58] Field of Search ..... 164/504, 468

[56] References Cited

U.S. PATENT DOCUMENTS

| | | | |
|---|---|---|---|
| 3,656,537 | 4/1972 | Von Starck | 164/468 X |
| 3,882,923 | 5/1975 | Alberny | 164/504 |
| 3,911,997 | 10/1975 | Sugazawa | 164/504 |
| 4,030,534 | 6/1977 | Ito | 164/468 X |

FOREIGN PATENT DOCUMENTS

| | | | |
|---|---|---|---|
| 2810491 | 9/1979 | Fed. Rep. of Germany | 164/468 |
| 55-92260 | 7/1980 | Japan | 164/468 |

*Primary Examiner*—Nicholas P. Godici
*Assistant Examiner*—G. M. Reid
*Attorney, Agent, or Firm*—Michael J. Striker

[57] ABSTRACT

In a continuous-casting method molten steel is continuously introduced into a continuous-casting mold to form therein a strand having a free surface in the mold, a pair of relatively wide faces, and a pair of relatively narrow faces. The mold and the steel therein are continuously cooled to externally solidify the molten-steel strand while leaving same internally molten and the externally solid and internally molten strand is continuously withdrawn from the lower end of the mold. The core of the strand solidifies increasingly as it moves from the mold and terminates downstream of the mold at a pool bottom. At each of a plurality of locations spaced apart about 1 m to 2 m longitudinally along the strand between the mold and the pool bottom a respective magnetic field is formed with the fields passing through the strand from between about 3 m to 7 m beneath the free surface to about 2 m to 6 m from the pool bottom. These fields are displaced transversely of and generally parallel to the side faces of the strand with each field moving opposite to the adjacent field or fields so as to magnetically transversely and oppositely displace respective portions of the molten core of the strand.

5 Claims, 3 Drawing Figures

ELECTROMAGNETICALLY STIRRING THE MELT IN A CONTINUOUS-CASTING MOLD

FIELD OF THE INVENTION

The present invention relates to the electromagnetic stirring of continuously cast metal strands, in particular of steel. More particularly this invention concerns the electromagnetic stirring effected in the secondary cooling zone of a machine for continuously casting strands.

BACKGROUND OF THE INVENTION

Standard electromagnetic stirring operations of the type to which the instant invention pertains comprise exposing the product being cast to one or more mobile magnetic fields that move in a predetermined direction and that act on the liquid metal to move same in the same direction as the field.

In the case of continuously cast strands of elongate sections destined to form slabs, the molten metal is made to move horizontally parallel to the wide faces of the strand.

The mobile magnetic field is normally created by a multiphase static inductor positioned immediately adjacent the cast product, of any of several designs such as, for example, a monobloc inductor of the type used in the stator of a linear-induction motor and placed behind the rollers that hold and guide the strand during casting, or instead used as one or more of these rollers (see French Pat. No. 2,068,803 and German Pat. No. 2,401,145), or placed in the gap between adjacent rollers (see French Pat. No. 2,187,468). It has also been proposed to use a cylindrical inductor which is fitted inside a tubular strand-guiding roller (see British Pat. No. 1,405,312).

The advantage of controlled stirring of the molten metal during casting, which has been recognized for a long time, is in the improved internal quality of the stirred product as compared to an unstirred product. This improved quality, which is characterized in particular by a reduction in central porosity as well as by a substantial reduction of axial macrosegregations, is created by the favorable influence of the stirring on the structure as it solidifies. This latter in fact shows how in stirred products there is a premature interruption of the peripheral crystalline "basaltic"-type or dendritic growth in favor of more formation and development of a central zone with an unoriented solidification structure, that is of the so-called "equiaxial" type.

Nonetheless, although the interrelation between cause and effect between a wide equiaxial zone and a small axial segregation cannot be denied, numerous metallographic observations of the instant inventors show that the axial segregation can nevertheless remain relatively great even with a well developed equiaxial zone.

OBJECTS OF THE INVENTION

It is therefore an object of the present invention to provide an improved method of electromagnetically stirring the melt in a continuous-casting mold, to produce a wide central equiaxial zone and the minimum amount of axial macrosegregation, and to do so more so than any of the prior-art stirring methods.

Another object is to do this with the smallest possible number of stirring inductors.

SUMMARY OF THE INVENTION

These objects are attained according to this invention in a method of electromagnetically stirring the melt of a continuously cast strand wherein in the portion of the pool that is downstream of the ingot mold in the extraction direction of the strand same is subject to at least one mobile magnetic field that moves across the large faces of the strand to create a driving movement of the liquid metal, the method being characterized in that a plurality of magnetic fields are used that move so as to stir the molten metal of the portion of the solidification length between about 3 m and 4 m under the free surface of the metal in the ingot mold and about 3 m from the bottom of the pool, that these magnetic fields are produced by electromagnetic inductors which are staggered along the solidification length at a spacing of about 1 m to 2 m, and that each inductor-created magnetic field moves in a direction opposite that of the adjacent inductor or inductors.

The pool, whose depth is the "solidification length", lies between the free surface of the metal in the ingot mold and the point downstream therefrom in the extraction direction of the product where the entire cross section of the cast product is solid, closing the pool.

In accordance with a particular embodiment of this invention that uses a minimum of electromagnetic inductors, same are disposed alternating along the solidification length, with the inductors being closest in the direction to any inductor being on the opposite side of the strand.

According to a preferred embodiment the electromagnetic inductor which is closest to the ingot mold is placed on the large face at the outside curve of the strand.

As will already doubtless have been understood, the invention basically consists in distributing the electromagnetic stirring energy that is transmitted to the cast metal over the major part of the solidification length so as to create convection movements which are spread throughout substantially the entire pool, with no dead recirculation zones being left in the metal between the inductors.

This being the case, it is not necessary to stir along the entire depth of the molten pool for the following reasons:

On the one hand it would be useless to have the magnetic field act in the vicinity of the lower end of the pool because at this location the metal is already sufficiently set that it is impossible to create convection movements therein, even using very strong electromagnets.

On the other hand it is not desirable to stir too high in the pool, in the immediate vicinity of the ingot mold, because the flow of liquid metal into the mold naturally creates favorable convection movements which extend in the pool to a distance equal to about two or three times the height of the mold and which should not be disturbed.

Therefore, it will readily be understood that the portion of the solidification length that should be electromagnetically stirred according to the invention is located between about an upper limit about 3 m to 4 m under the free surface of the metal in the ingot mold and a lower limit about 2 m to 3 m above the pool bottom.

In order to determine where to locate the inductors for such stirring, it must be recognized that a direct driving of the magnetic field at any level in the pool induces dead recirculation movements of the liquid metal, so-called indirect driving, which cause crossed flow and which extend about 2 m to 3 m in each direction from a direct-drive zone.

Taking this into account, the furthest upstream magnet field is about 5 m to 7 m under the free surface of the liquid metal and the furthest downstream field is about 4 m to 5 m from the pool bottom.

Of course, the average distance separating a direct-drive zone from a dead recirculation zone depends primarily on the field strength to which the liquid metal is subjected, since the displacement speed of the field, established by the frequency of the current energizing the inductor, is necessarily small, from about 1 Hz to 5 Hz, so as to limit attenuation of the field between the active surface of the inductor and the liquid metal.

It may however be stated that taking into account the state of the art, electromagnetic inductors exist for continuous-casting installations which are sufficiently powerful that the direct drive zone and the dead recirculation zone can be spaced apart by 2 m or even more.

It may be useful to state the regions along the solidification length where the dead recirculation zones are can easily be detected. These zones appear in standard Baumann prints in a cross section of the bar as light-colored rings, known also as negative segregation zones or "white bands", and appear more blurry than the negative segregation rings which are formed at the level where the magnetic field is more directly effective. The depth at which these different negative segregation zones are located in the product depends on the actual operating conditions of the casting machine and particularly on the initial heat of the metal being poured into the ingot mold, also on the extraction speed of the product, and on the cooling and solidification rate determined by the setting of the cooling system. Knowing these different parameters allows the depth of the negative segregation zones to be readily identified with the regions along the solidification length where the direct circulation and the recirculation movements of the metal are effected by the magnetic fields.

It should be emphasized that the same parameters allow the upper and lower limits defining the region of the solidification length subjected to stirring in accordance with the invention to be approached fairly closely in all cases. By way of example, the extraction speed may range from 0.7 m/min to more than 3 m/min, by a factor of five depending on different equipment and grade of steel.

DESCRIPTION OF THE DRAWING

There will now be described by way of illustration an exemplary embodiment of the method of this invention using a minimum number of stirring inductors and serving to continuously cast a strand at a low extraction speed of about 0.7 m/min and with a solidification length or pool depth of about 12 m.

The description of this example refers to the accompanying drawing in which.

SPECIFIC DESCRIPTION

Figure 1:
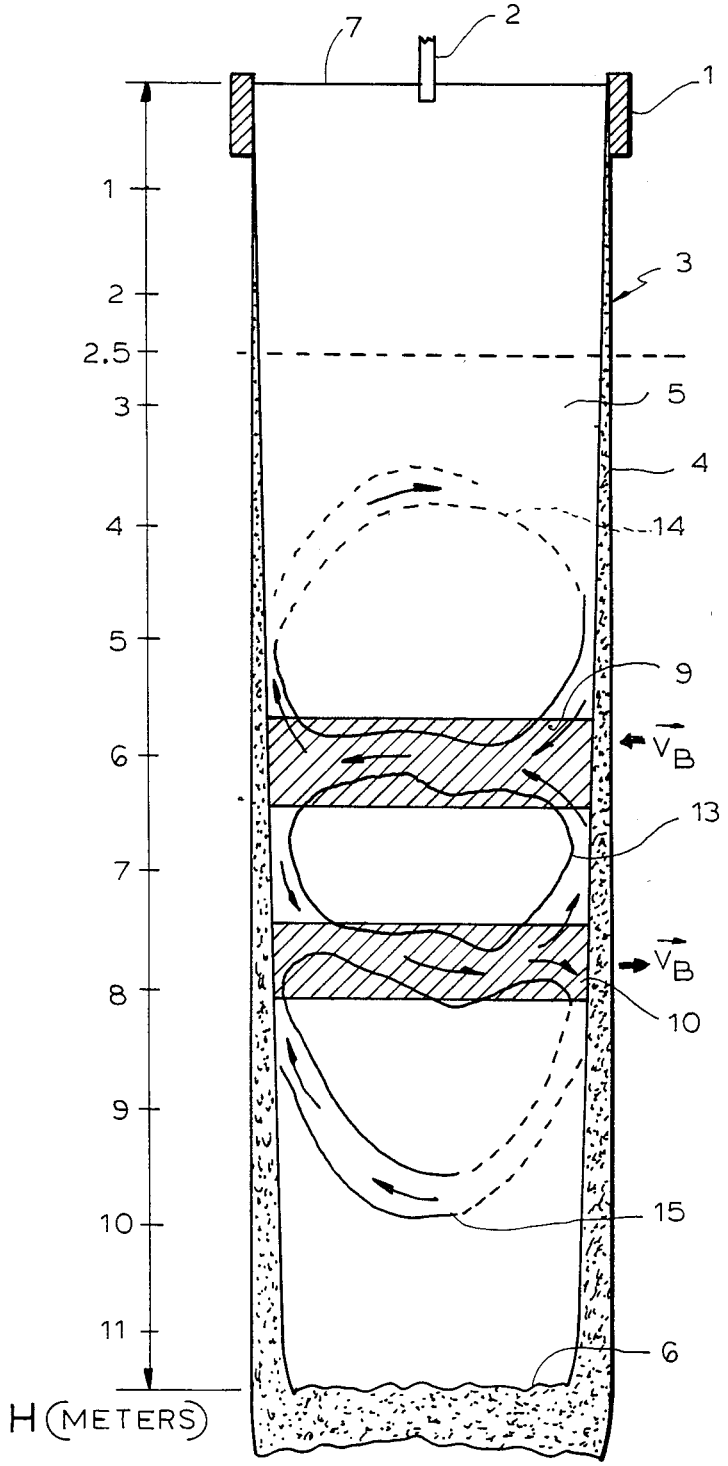
FIG. 1 is a longitudinal section through a strand taken parallel to the wide faces thereof.
Figure 2:
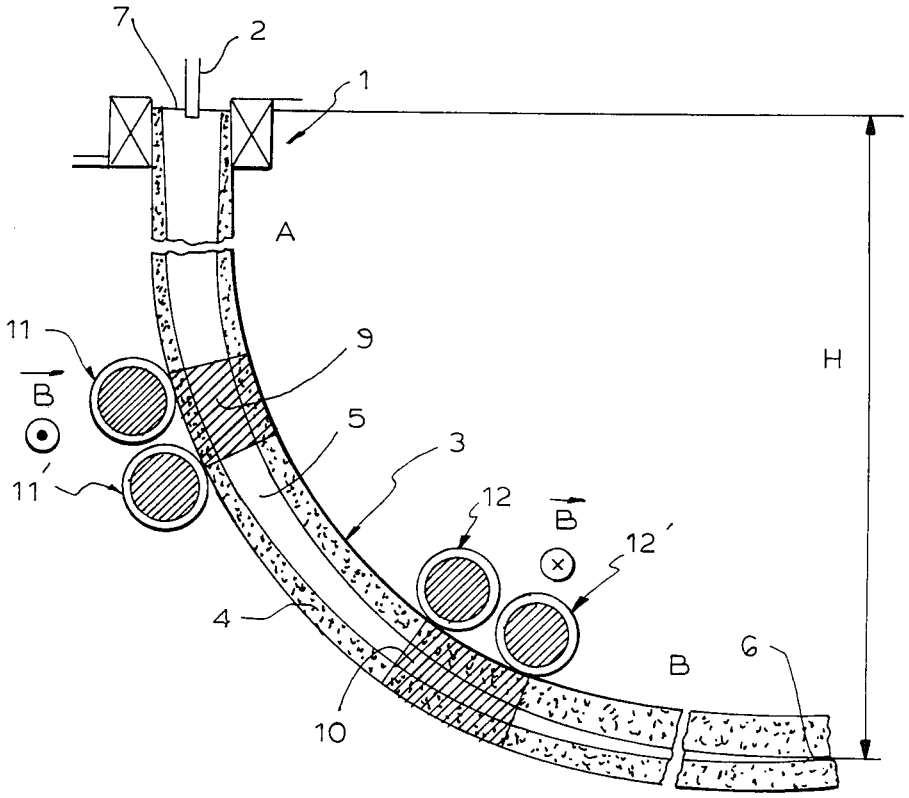
FIG. 2 is a view similar to FIG. 1 but taken parallel to the narrow faces of the workpiece.

FIGS. 1 and 2 show schematically an ingot mold 1 and a nozzle 2 supplying the mold 1 with liquid metal to form a strand 3 having a solidified outer layer 4 and a molten core or pool 5. The pool 5 has a pool bottom 6 where the solidifying fronts of the large faces of the product join. The solidification length H which is the distance between the free surface 7 of the molten metal in the ingot mold and the pool bottom 6 is shown in meters on the left-hand side of the strand 3 in FIG. 1. The direct-action zones of the transversely moving magnetic fields are shown hatched at 9 and 10. These zones, as has been mentioned, define the regions of direct drive of the molten metal whose current lines have been shown as thick-line loops 13 in FIG. 1. The displacement directions of the magnetic fields over the width of the strand 3 are shown by arrows in FIGS. 1 and 2 adjacent the zones 9 and 10.

The invention is easily carried out by means of moving-field inductors of cylindrical shape, as shown very schematically in FIG. 2 placed inside tubular rollers that support and guide the strand 3. The assembly thus formed by the roller and internal inductor is a standard prefabricated unit normally termed a "stirrer-roller". Such a stirrer-roller, since it does not form part of the instant invention, will not be described in greater detail here. If desired, reference can be made to British patent application No. 1,405,312 assigned to the assignee of the instant application for a detailed description of their design and technology.

So as not to needlessly overload the drawing, the stirrer-rollers have not been shown in FIG. 1. In FIG. 2 only stirrer-rollers 11, 11' and 12, 12' have been illustrated, to the exclusion of all the other rollers ordinarily provided spaced closely apart along the large faces of the strand.

The minimum structure necessary to distribute the action of the magnetic field over the solidification length according to the invention is here formed by a first pair of stirrer-rollers 11, 11' on the outside curve of the strand 3 downstream of the ingot mold about 6 m from the free surface 7 of the metal, and by a second pair of rollers 12, 12' offset downstream from the pair 11, 11' by an average distance of 1.5 m. In addition the displacement direction of the magnetic field created by the pair 11, 11' is opposite to that created by the pair 12, 12'.

Thus the electromagnetic stirring caused by the sliding fields acting on the two regions 9 and 10 creates in the liquid metal convection movements in the form of a triple O or butterfly wings which form over the major portion of the solidification length, that is over the portion between the upper limit level about the 3.5 m mark and the lower limit close to the 10 m mark. More precisely this butterfly-wing movement comprises as illustrated a central body 13 between the inductors and having relatively intense circulation since it is created by two oppositely moving direct-drive zones 9 and 10 and, on each side of the central body 13, dead recirculation zones 14 and 15 which extend respectively upward and downward to the upper 3.5 m level and the lower 10 m level.

Figure 3:
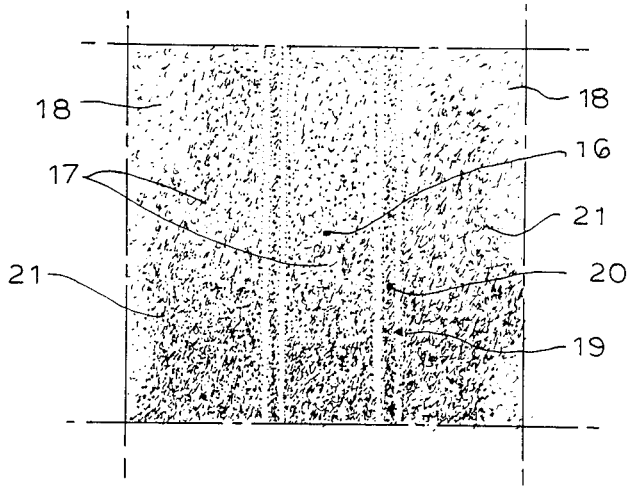
FIG. 3 is a Baumann print of the central part of the cross section of a solidified bloom.

Metallographic analyses made show that products continuously cast and stirred in the way described immediately above have a very wide equiaxial solidification which starts at a skin depth corresponding to the level on the solidification length of about 3.5 m. In addition these analyses show also that the core of the cast product is practically free of macrosegregation phenomena. These results can be seen directly in FIG. 3 where the axis of the strand and of the ingot are shown at 16, the wide equiaxial solidification area at 17, and the fringe of oriented basaltic separation at 18, the last-mentioned being hard to see in the drawing. The drawing clearly shows, however, that within the equiaxial area 17 there are two concentric light-colored rings 10 and 20 adjacent one another and showing the negative segregation phenomena formed by the stirring action in the direct-drive regions 9 and 10. Also visible around and at a spacing from these rings, is another negative segregation ring 21 that is more attenuated and that shows the presence of the upper recirculation region 14 of FIG. 1. It should be noted that the negative segregation ring corresponding to the lower recirculation region 15 cannot be seen in the metallographic section of FIG. 3 for this region is so solid that it has a rigid skeleton which prevents the forced convection currents in the liquid metal that are responsible for the negative segregation.

It goes without saying that the invention is not limited to the example described and extends to numerous variations and equivalents to the extent that the characteristics set forth in the accompanying claims are respected.

This is particularly the case for the number of moving magnetic fields, that is the number of direct-drive regions that are spaced along the solidification length, provided however that the direction of the movement of the fields is reversed from on to the other in the consecutive direct-drive zones so as to avoid the formation of dead recirculation zones between these direct-drive zones.

Similarly, the fact that the direct-drive zones 9 and 10 are each created by two electromagnetic inductors 11, 11' and 12, 12' does not limit the scope of this invention. These arrangements are in fact explained solely by the desire to work during testing with electromagnetic powers of the order of 150 KVA for each direct drive zone, whereas the nominal rating of the available inductors was at most 125 KVA.

Thus it will be understood that the paired inductor units on the same face of the bloom such as 11 and 11' or 12 and 12', or paired at the same level along the solidification length on the two opposite faces of the slab form a single inductor because they are intended produce the same direct-drive zone in the liquid metal. In particular the direction of displacement of the magnetic fields is the same within each inductor unit.

What is claimed is:

1. In a continuous-casting method wherein:

molten steel is continuously introduced into a continuous-casting mold to form therein a strand having a free surface in the mold, a pair of relatively wide faces, and a pair of relatively narrow faces;

the mold and the steel therein are continuously cooled to externally solidify the molten-steel strand while leaving same internally molten; and the externally solid and internally molten strand is continuously withdrawn from the lower end of the mold, the core of the strand solidifying increasingly as it moves from the mold and terminating downstream of the mold at a pool bottom, the improvement comprising the steps of:

forming at each of a plurality of locations spaced apart about 1 m to 2 m longitudinally along the strand between the mold and the pool bottom a respective magnetic field, the fields passing through the strand from between about 3 m to 7 m beneath the free surface to about 2 m to 6 m from the pool bottom; and displacing the fields transversely of and generally parallel to the side faces of the strand with each field moving opposite to the adjacent field or fields so as to magnetically transversely and oppositely displace respective portions of the molten core of the strand.

2. The method defined in claim 1 wherein the fields are formed by coils staggered on opposite sides of the strand at the wide faces.

3. The method defined in claim 2 wherein the strand is pulled vertically down and then is curved upstream of the pool bottom to move horizontally with the one wide face being on the outside of the curve and the other wide face on the inside of the curve.

4. The method defined in claim 3 wherein the furthest downstream coil is on the inside wide face of the curve.

5. The method defined in claim 3 wherein the furthest upstream coil is on the outside wide face of the curve.

* * * * *